US009557091B1

(12) United States Patent
Zardo et al.

(10) Patent No.: US 9,557,091 B1
(45) Date of Patent: Jan. 31, 2017

(54) SPLIT AIR PATHWAY

(71) Applicant: Whirlpool Corporation, Benton Harbor, MI (US)

(72) Inventors: Daniel Zardo, Evansville, IN (US); Matthew P. Dieg, Evansville, IN (US); Michael Heaven, Coralville, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 716 days.

(21) Appl. No.: 13/749,935

(22) Filed: Jan. 25, 2013

(51) Int. Cl.
*F25D 11/02* (2006.01)
*F25D 17/06* (2006.01)
*F25D 23/06* (2006.01)

(52) U.S. Cl.
CPC ..... *F25D 11/02* (2013.01); *F25D 17/065* (2013.01); *F25D 23/061* (2013.01); *F25D 23/068* (2013.01); *F25D 2317/061* (2013.01); *F25D 2317/0666* (2013.01)

(58) Field of Classification Search
CPC ..... F25D 11/02; F25D 17/062; F25D 17/065; F25D 23/061; F25D 23/068; F25D 23/123; F25D 2317/061; F25D 2317/0666
See application file for complete search history.

(56) References Cited

U.S. PATENT DOCUMENTS

| | | | | |
|---|---|---|---|---|
| 3,375,677 | A * | 4/1968 | Bright et al. | 62/89 |
| 6,347,530 | B1 * | 2/2002 | Kim | 62/407 |
| 6,945,068 | B2 * | 9/2005 | Kim | F25C 5/005 62/353 |
| 7,240,510 | B2 | 7/2007 | Lee | |
| 7,299,651 | B2 * | 11/2007 | Oh | 62/407 |
| 7,392,665 | B2 | 7/2008 | Lee | |
| 7,520,139 | B2 | 4/2009 | Kim | |
| 7,654,105 | B2 | 2/2010 | Lee | |
| 2006/0086129 | A1 * | 4/2006 | Anselmino et al. | 62/344 |
| 2009/0113924 | A1 * | 5/2009 | Bae et al. | 62/447 |
| 2011/0011118 | A1 * | 1/2011 | Cho et al. | 62/419 |
| 2011/0113811 | A1 | 5/2011 | Lee | |

* cited by examiner

*Primary Examiner* — Orlando E Aviles Bosques

(57) ABSTRACT

A refrigerator includes a refrigerator cabinet, a freezer compartment disposed within the refrigerator cabinet, a fresh food compartment disposed within the refrigerator cabinet, an ice making compartment remote from the freezer compartment, and a fresh food compartment duct riser extending upwardly along a back of the fresh food compartment. The refrigerator further includes a shroud associated with a freezer compartment evaporator, an ice compartment supply duct leading from the shroud to the ice making compartment, and an ice compartment return duct leading from the ice making compartment towards the freezer compartment evaporator. The ice compartment supply duct has a split pathway and is positioned behind the fresh food compartment duct riser.

19 Claims, 16 Drawing Sheets

SPLIT AIR PATHWAY

FIELD OF THE INVENTION

The present invention relates to refrigerators. More particularly, the present invention relates to providing an air supply to and from a remote ice making compartment from a freezer.

BACKGROUND

In various configurations of refrigerators such as where the freezer is bottom mounted (below a fresh food compartment), a remote ice making compartment may be placed in the fresh food compartment to make ice which may then be dispensed through a dispenser on a door of the fresh food compartment. One of the problems with such a configuration relates to the routing of air to and from the remote ice making compartment. Another problem relates to routing air to and from the fresh food compartment in a manner that does not interfere with shelving in the fresh food compartment. What is needed is an improved refrigerator which addresses such problems.

SUMMARY OF THE INVENTION

Therefore it is a primary object, feature, or advantage of the present invention to improve over the state of the art.

It is a further object, feature, or advantage of the present invention to provide a refrigerator with an ice making compartment remote from a freezer.

A still further object, feature, or advantage of the present invention is to route supply air and return air from a freezer of a refrigerator to a remote ice making compartment of the refrigerator.

Another object, feature, or advantage of the present invention is to route air to and from a remote ice making compartment of the refrigerator separate from air routed to and from a fresh food compartment of the refrigerator.

Yet another object, feature, or advantage of the present invention is to route air to and from a fresh food compartment of the refrigerator in a manner which does not interfere with shelving within the fresh food compartment.

One or more of these and/or other objects, features, and advantages of the present invention will become apparent from the specification and claims that follow. No single embodiment need exhibit each and every object, feature, and advantage as different embodiments may have different objects, features, or advantages. The present invention is not to be limited by or to these objects, features, and advantages.

According to one aspect, a refrigerator is provided. The refrigerator includes a refrigerator cabinet, a freezer compartment disposed within the refrigerator cabinet, a fresh food compartment disposed within the refrigerator cabinet, an ice making compartment remote from the freezer compartment, and a fresh food compartment duct riser extending upwardly along a back of the fresh food compartment. The refrigerator further includes a shroud associated with a freezer compartment evaporator, an ice compartment supply duct leading from the shroud to the ice making compartment, and an ice compartment return duct leading from the ice making compartment towards the freezer compartment evaporator. The ice compartment supply duct has a split pathway and is positioned behind the fresh food compartment duct riser.

According to another aspect, a refrigerator is provided. The refrigerator includes a refrigerator cabinet, a fresh food compartment disposed within the refrigerator cabinet, a freezer compartment disposed within the refrigerator cabinet and below the fresh food compartment, and an ice making compartment remote from the freezer compartment, the ice making compartment containing an ice maker. The refrigerator further includes a fresh food compartment duct riser extending upwardly along a back of the fresh food compartment, an ice compartment supply duct embedded in foam behind the fresh food compartment duct riser and leading upwardly to the ice making compartment, and an ice compartment return duct leading downwardly from the ice making compartment.

According to another aspect, a refrigerator includes a refrigerator cabinet, a fresh food compartment disposed within the refrigerator cabinet, a freezer compartment disposed within the refrigerator cabinet and below the fresh food compartment, an ice making compartment remote from the freezer compartment, the ice making compartment containing an ice maker, and an ice compartment supply duct leading upwardly to the ice making compartment for supplying air to the ice making compartment, the ice compartment supply duct having a first portion and a second portion, the first portion and the second portion joined at a top of the ice compartment supply duct, separated at intermediate portions to form a recess therebetween, and joined at a lower portion of the ice compartment supply duct. The refrigerator further includes an ice compartment return duct leading downwardly from the ice making compartment for returning air from the ice making compartment, a fresh food compartment duct riser extending upwardly along the back of the fresh food compartment, the fresh food compartment duct riser covering the ice compartment supply duct, a shelf support positioned within the recess, and at least one shelf supported by the shelf support.

DETAILED DESCRIPTION

Figure 1:
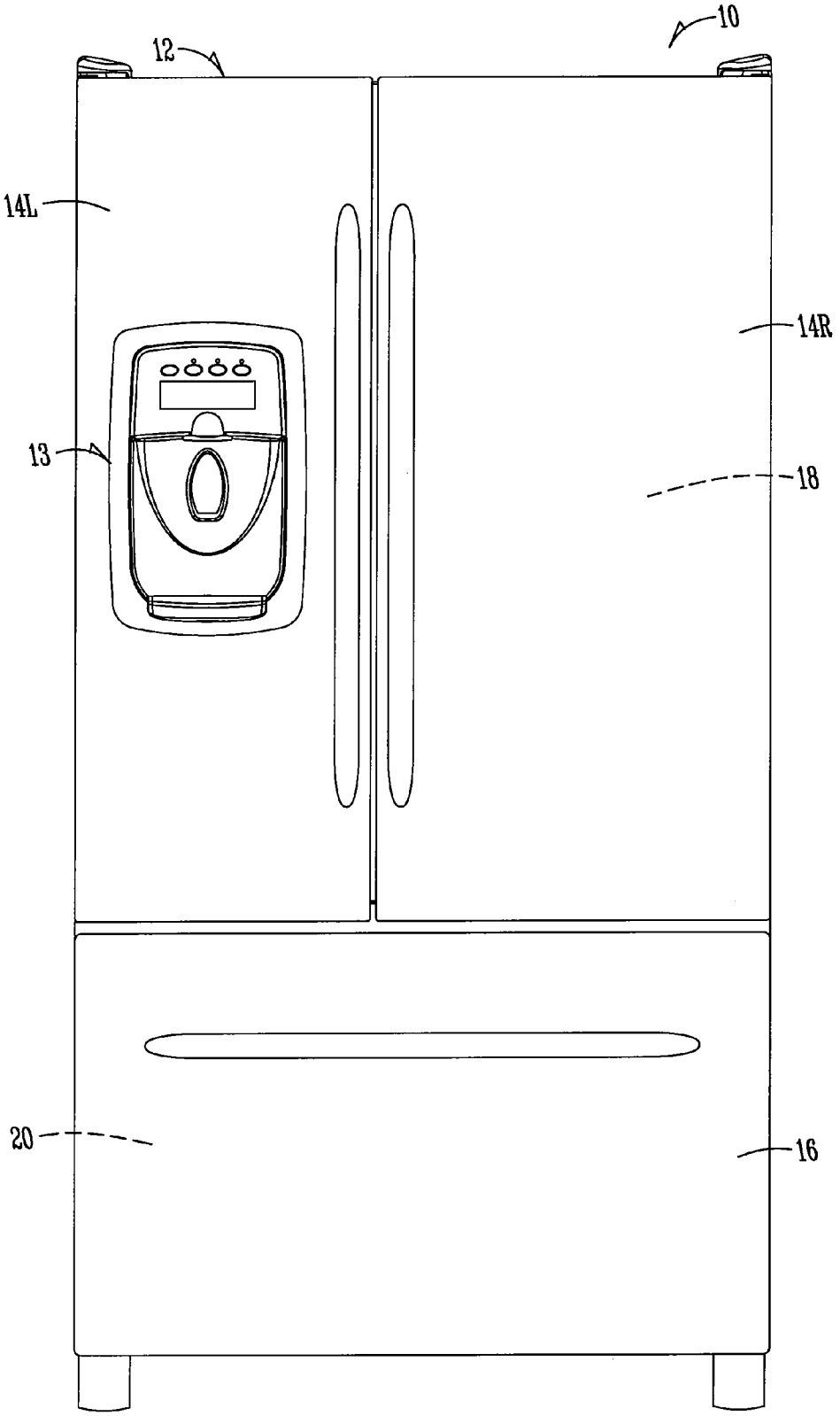
FIG. 1 illustrates one embodiment of a refrigerator.

FIG. 1 illustrates one embodiment of a refrigerator of the present invention. In FIG. 1 a refrigerator 10 has a cabinet 12. Fresh food compartment French doors 14L, 14R are shown for providing access to the fresh food compartment 18. A freezer compartment drawer 16 is shown for providing access the freezer compartment 20. As shown in FIG. 1, the freezer compartment 20 is mounted on the bottom of the fresh food compartment 18. A water and ice dispenser 13 is positioned on one of the left fresh food compartment door14L.

Figure 1A:
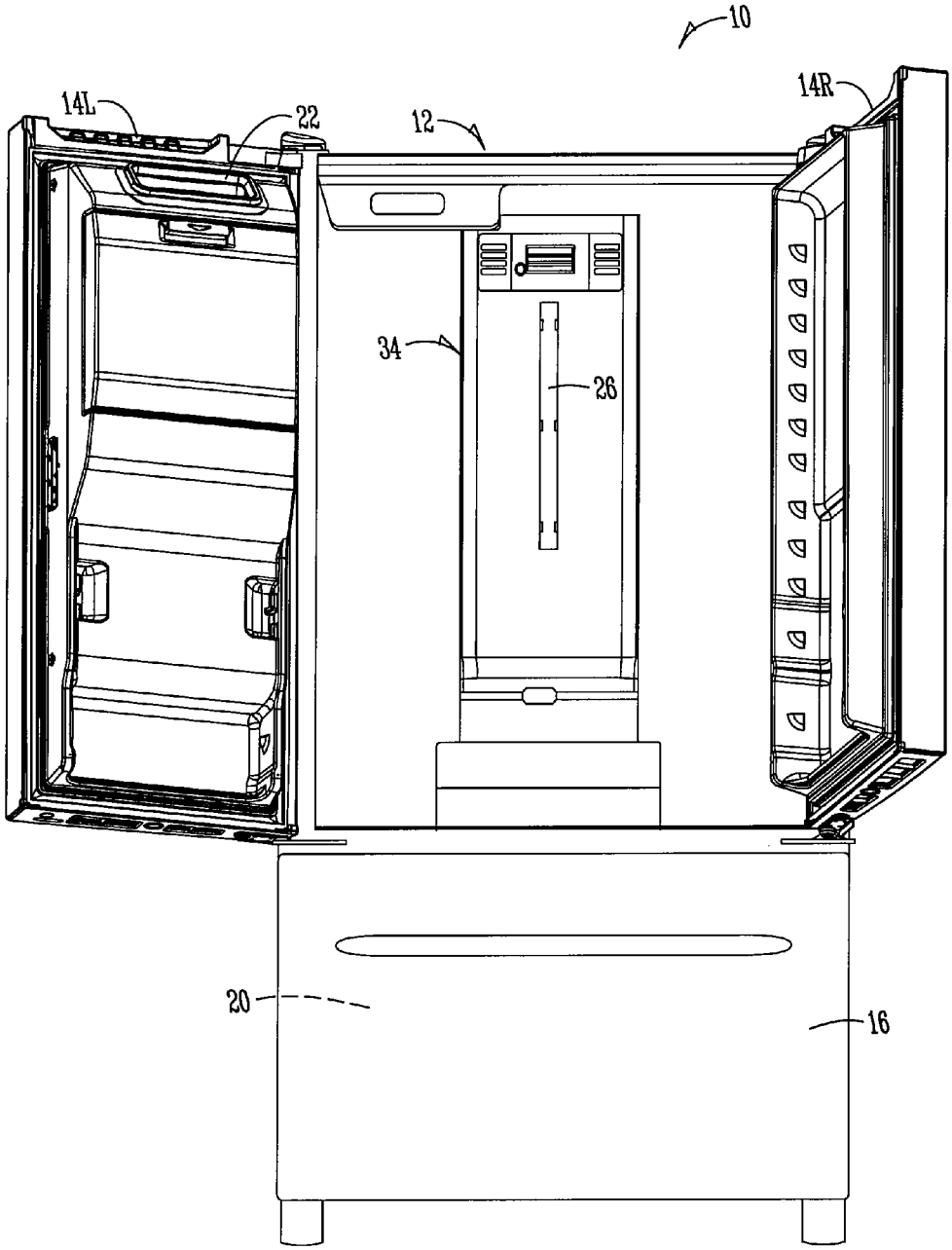
FIG. 1A illustrates the refrigerator with the French doors open.

In the configuration of a refrigerator shown in FIG. 1, ice is made within an ice making compartment which is remote from the freezer compartment and delivered to the water and ice dispenser 13. The ice making compartment may be insulated and may be formed from the liner of the fresh food compartment or otherwise. FIG. 1A illustrates the refrigerator 10 with the French doors 14L, 14R open and showing the ice making compartment 22 within the fresh food compartment 18. Note that the ice making compartment 22 is remote from the freezer compartment 20, an ice maker and ice storage bin may be disposed within the ice making compartment 22.

Figure 2:
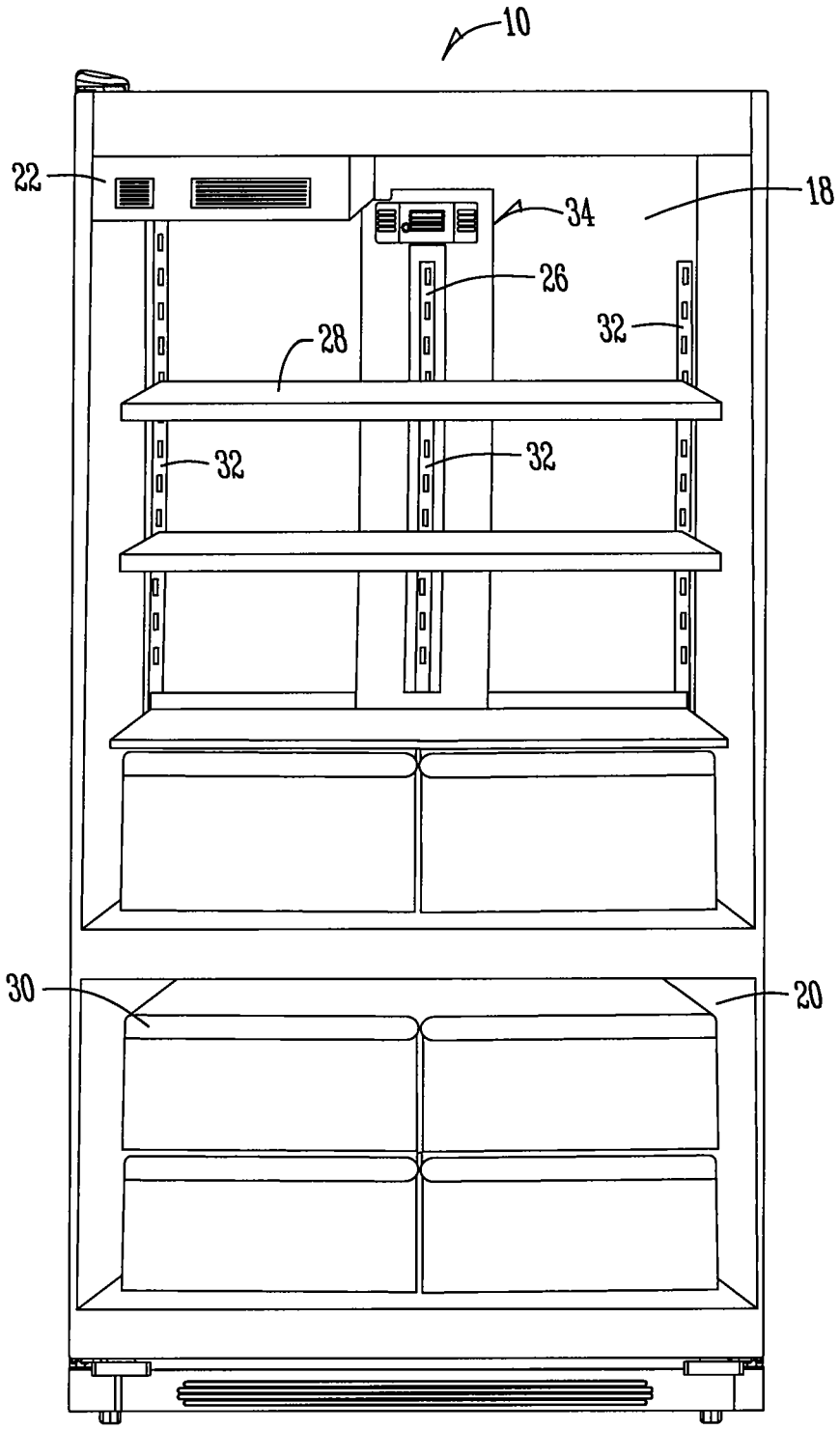
FIG. 2 illustrates an interior view of the refrigerator of FIG. 1.

FIG. 2 illustrates the interior of one such example of a refrigerator 10. The freezer compartment 20 may include one or more drawers 30. A plurality of shelf supports 32 are shown in the fresh food compartment 18 for supporting shelves 28. The middle one of the shelf supports 32 is positioned within a recess 26 of a fresh food compartment duct riser 34 which extends upwardly along a back of the fresh food compartment. The recess 26 is a space which may be between the split portions of the fresh food compartment duct riser 34. One of the advantages of such a design is maximizing useable space within the fresh food compartment of a refrigerator by placement of a shelf support 32 within the recess 26 while still allowing cold air to be supplied to the refrigerator or fresh food compartment 18.

Figure 3:
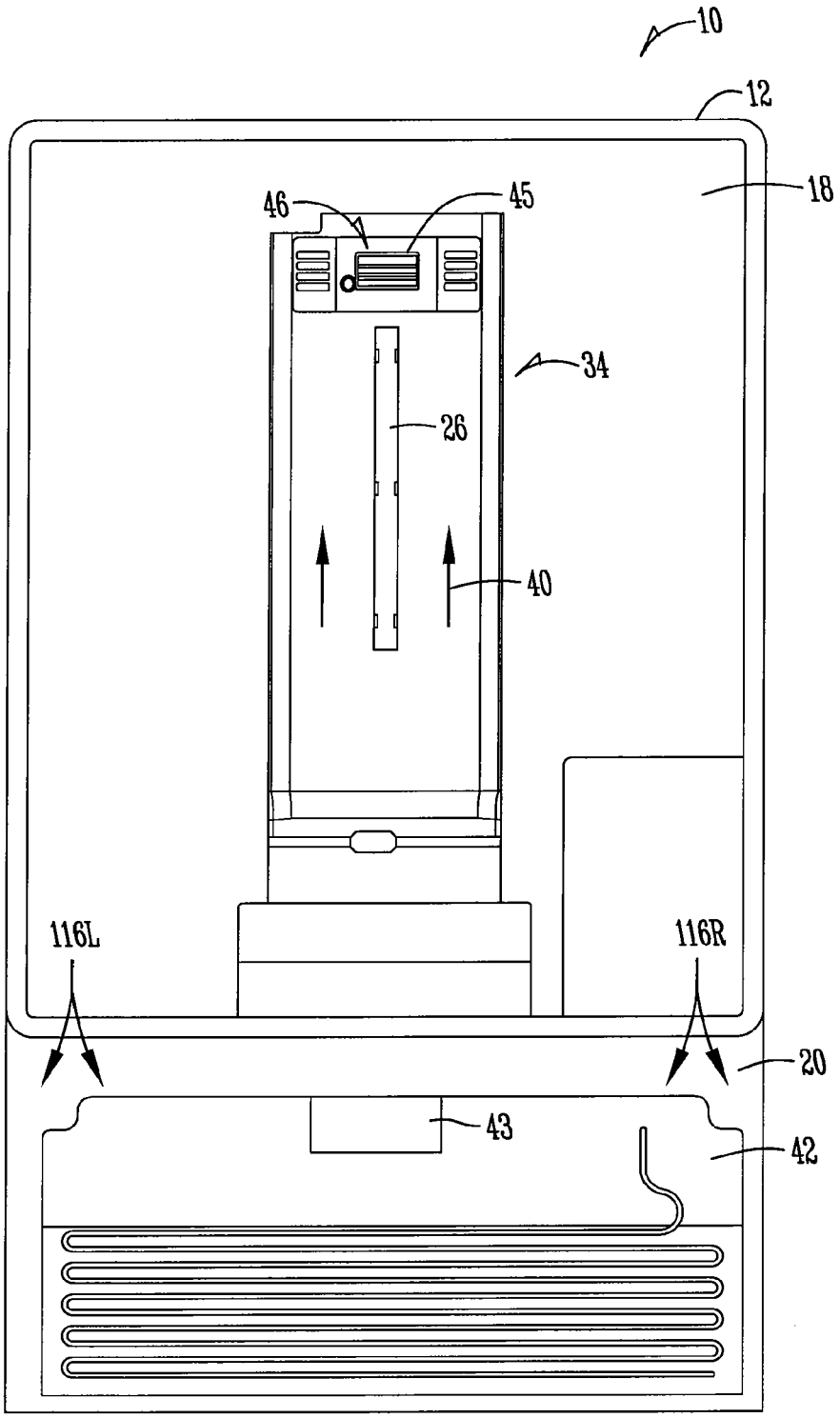
FIG. 3 illustrates another view of the refrigerator showing the split air pathway.
Figure 3A:
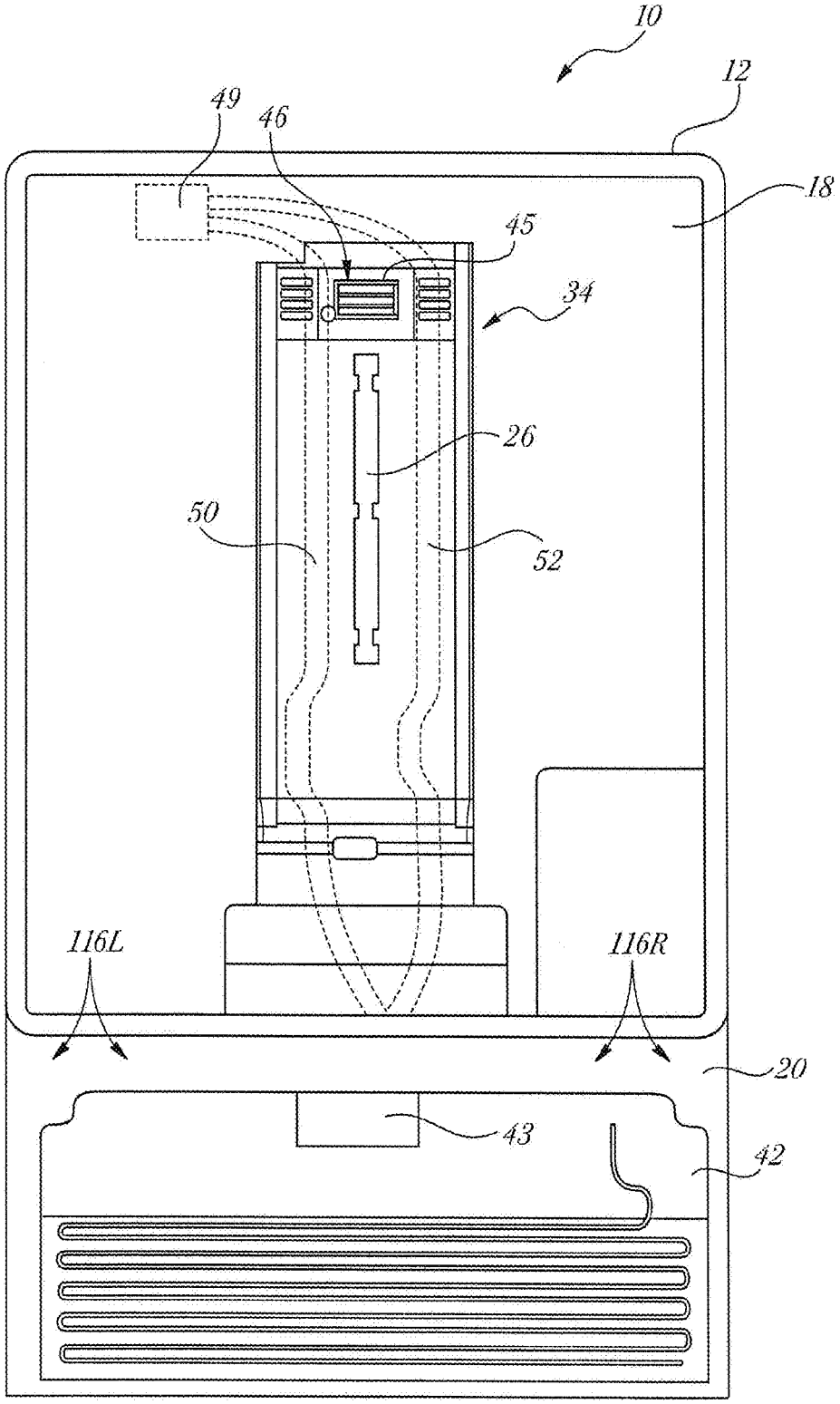
FIG. 3A illustrates a view similar to FIG. 3 showing the ice compartment supply duct in phantom lines behind the fresh food compartment duct riser.
Figure 5:
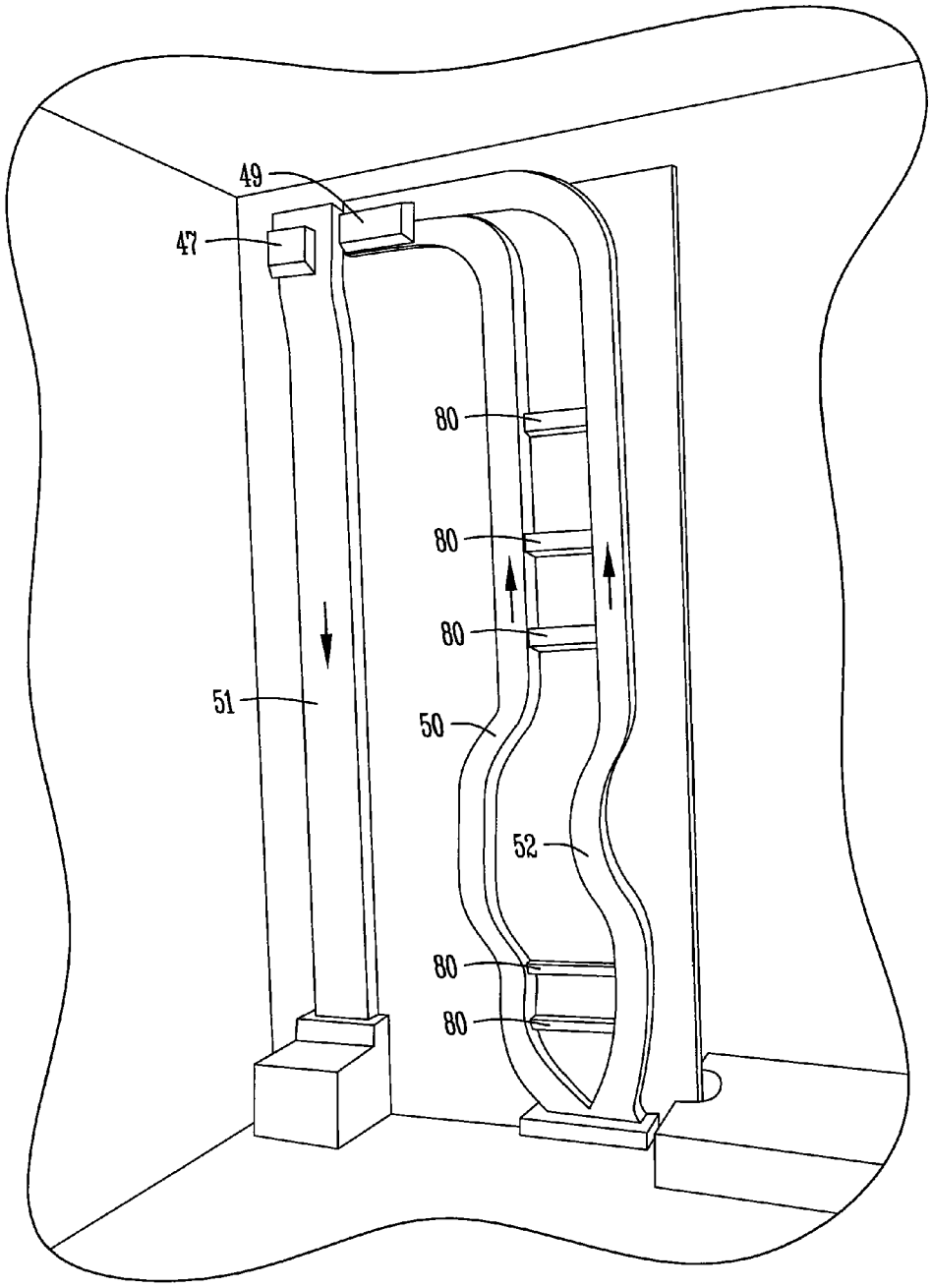
FIG. 5 illustrates an additional example of the ice compartment supply duct and the ice compartment return duct.
Figure 5A:
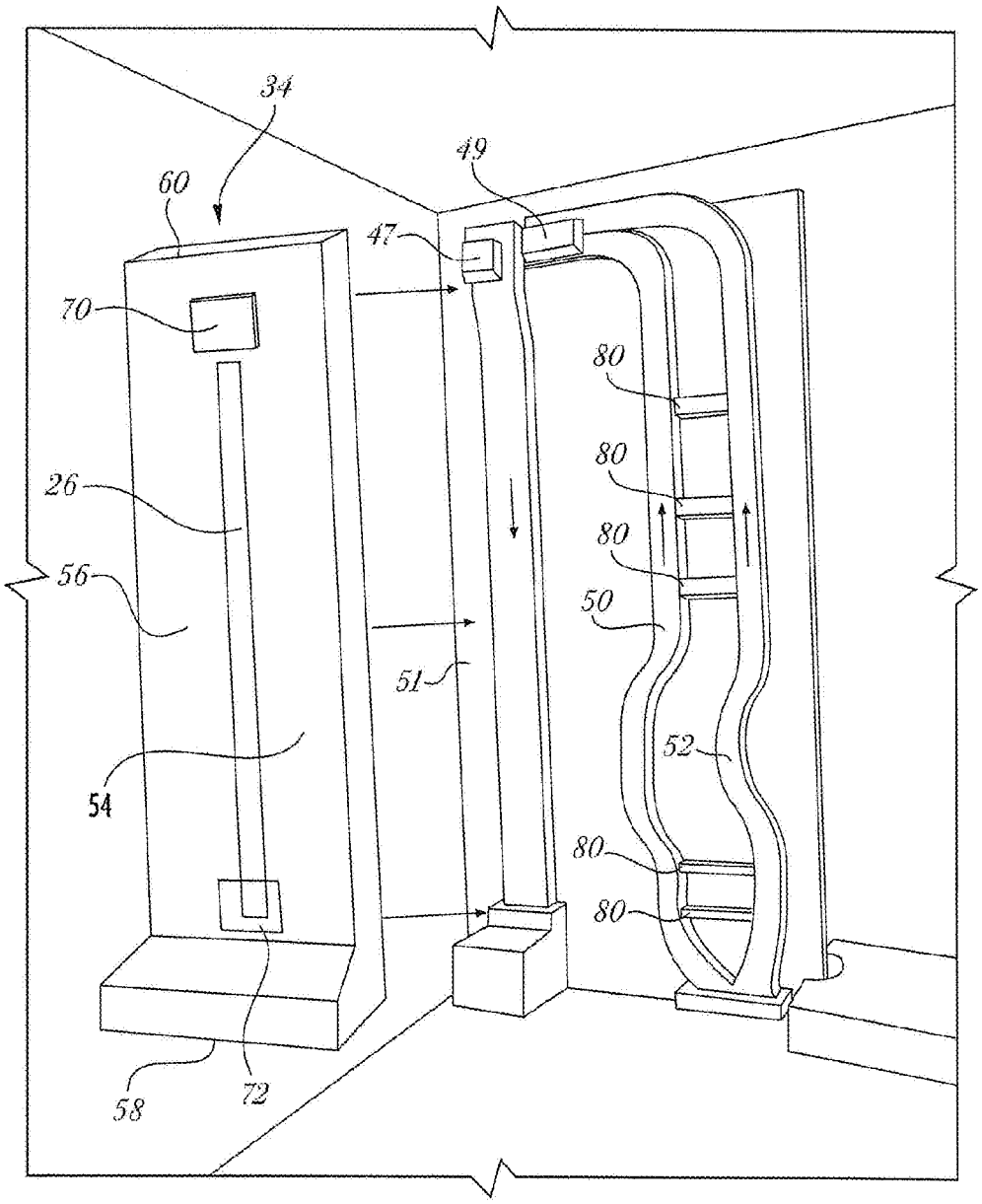
FIG. 5A illustrates a view similar to FIG. 5 showing how the fresh food compartment duct riser is placed over the ice compartment supply duct.

FIG. 3 further illustrates air distribution features of the refrigerator 10. The fresh food compartment duct riser 34 is shown. An opening 46 is provided for air and a filter door 45 may be present at the opening 46. Behind the fresh food compartment duct riser 34 are ice making compartment supply ducts 50, 52 as shown in FIGS. 3A and 5A. The ice making compartment supply ducts 50, 52 may be foamed in-place. Supply air as indicated by arrow 40 may travel upwardly through a refrigerator compartment supply duct. Return air may ultimately travel downwardly to an evaporator 42. Supply air may be provided by an evaporator fan shroud 43 associated with a freezer compartment evaporator 42. Note that the fresh food compartment duct riser 34 has a split air pathway.

Figure 4:
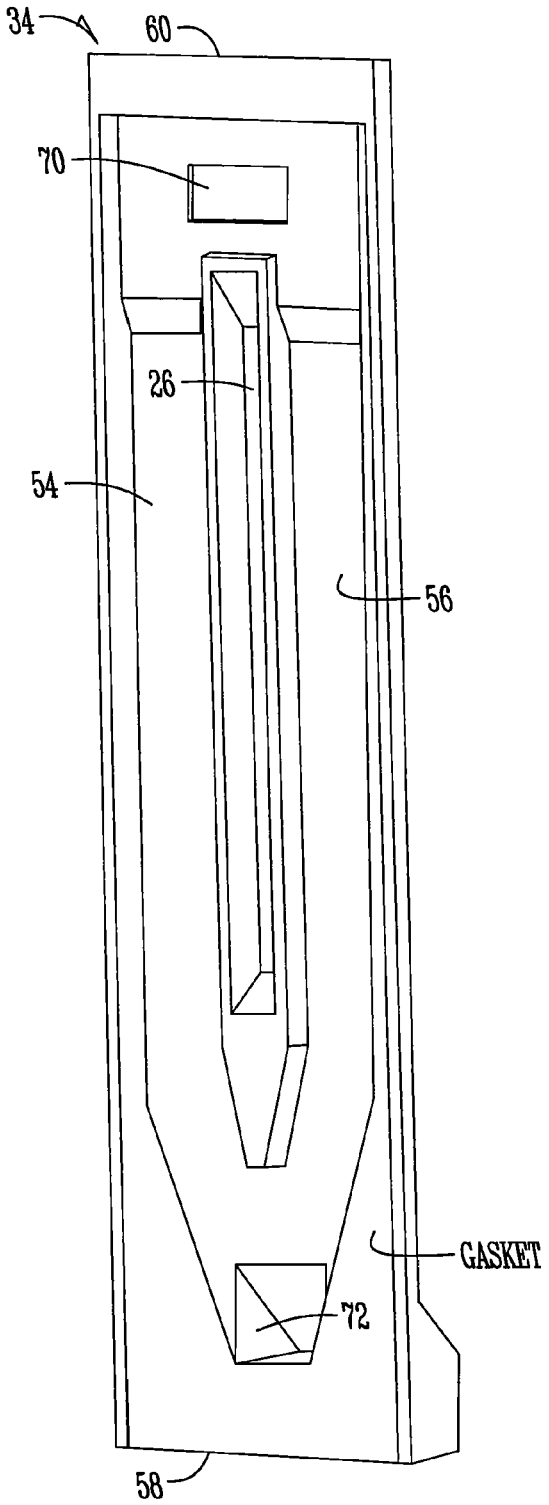
FIG. 4 illustrates the ice compartment duct riser.

FIG. 4 illustrates a rear view of the fresh food compartment duct riser 34 as may be mounted at a back of the fresh food compartment and sealed with a gasket. The fresh food compartment duct riser 34 has a top end 60 and a bottom end 58 with an opening 70 near the top end 60 and an opening 72 near the bottom end 58. A supply duct portion 54 and a supply duct portion 56 are joined together at their upper portions, separated at their immediate portions to form the recess 26 therebetween, and joined at their lower portions. Thus, the fresh food compartment supply duct portion 54 and the fresh food compartment supply duct portion 56 may share an opening 70 at an upper portion of the fresh food compartment. The recess 26 or spacing between the supply duct portion 54 and the supply duct portion 56 at their immediate portions may be used to access a shelf support.

Figure 6:
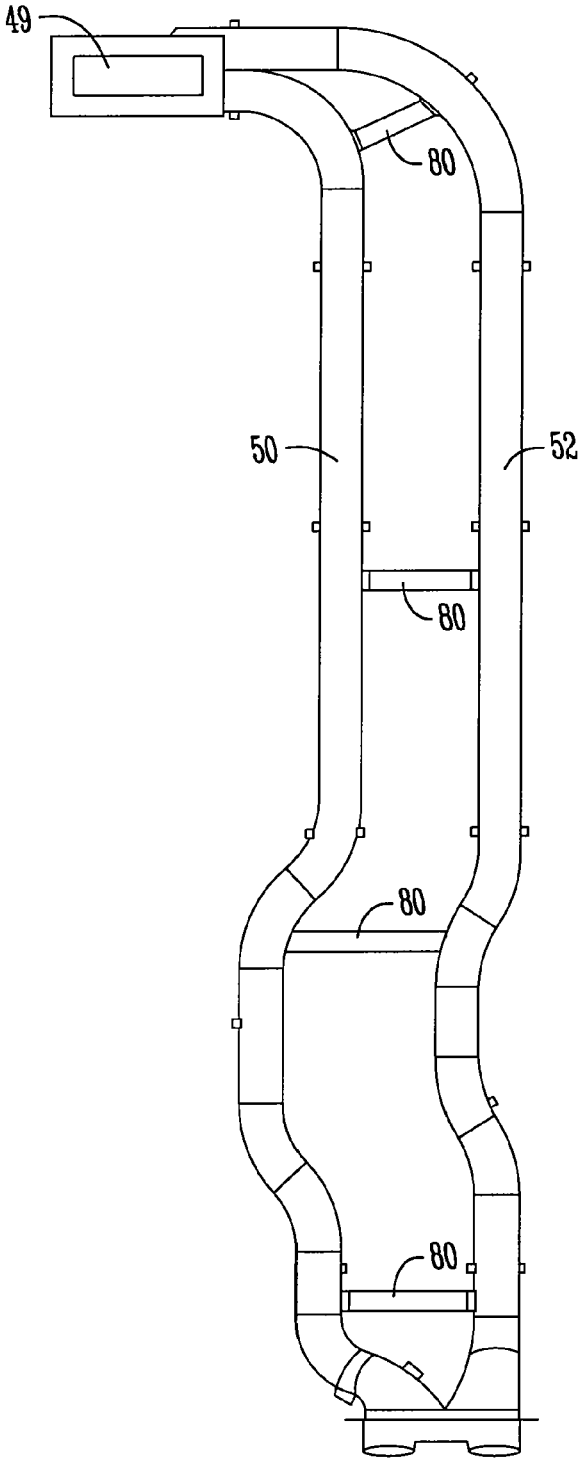
FIG. 6 illustrates another view of the ice compartment supply duct.
Figure 7:
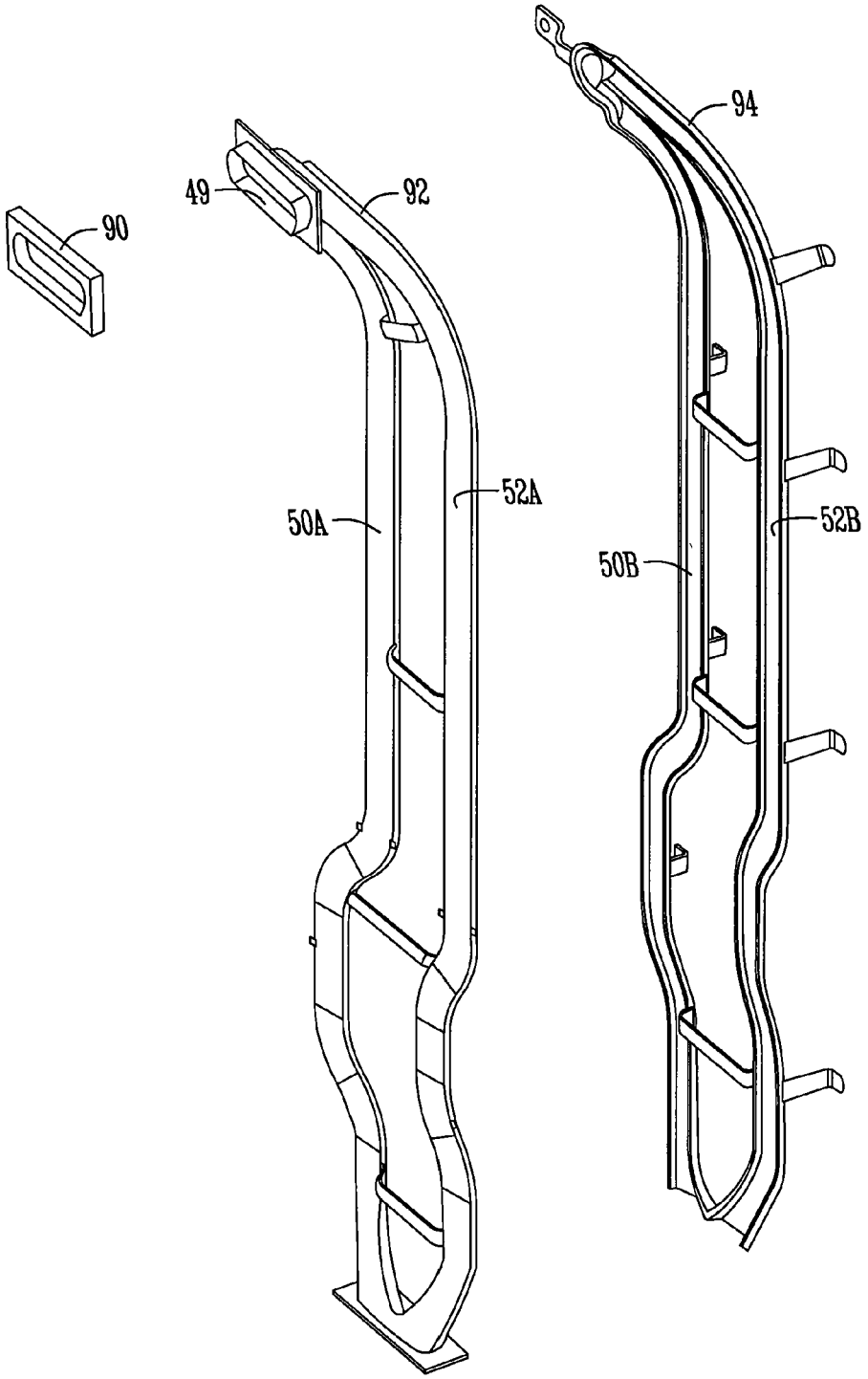
FIG. 7 illustrates another view of the ice compartment supply duct.

The fresh food compartment duct riser 34 may define the air passage way to the fresh food compartment. Alternatively, or in addition to the use of risers, ducts in the form of tubing may be used as shown in FIG. 5 which may be foamed in place behind the fresh food compartment duct riser. As shown in FIG. 5, the ice compartment supply ducts 50, 52 may be formed of plastic tubing with support ribs 80 therebetween. The ice compartment supply ducts 50, 52 provides cold air to the ice maker 22 which may be disposed in the ice making compartment. An ice making compartment return duct 51 is shown to return air from the ice making compartment. FIG. 6 illustrates another view of the ice compartment supply ducts 50, 52 wherein the ducts 50, 52 are separated into a first portion 50A, 52A and a second portion 50B, 52B. FIG. 7 illustrates another view of the ice compartment supply ducts 50, 52 which provide a split air pathway. An air duct gasket 90 is shown and a cover 92 for attaching to a body 94 of the supply duct.

Figure 8:
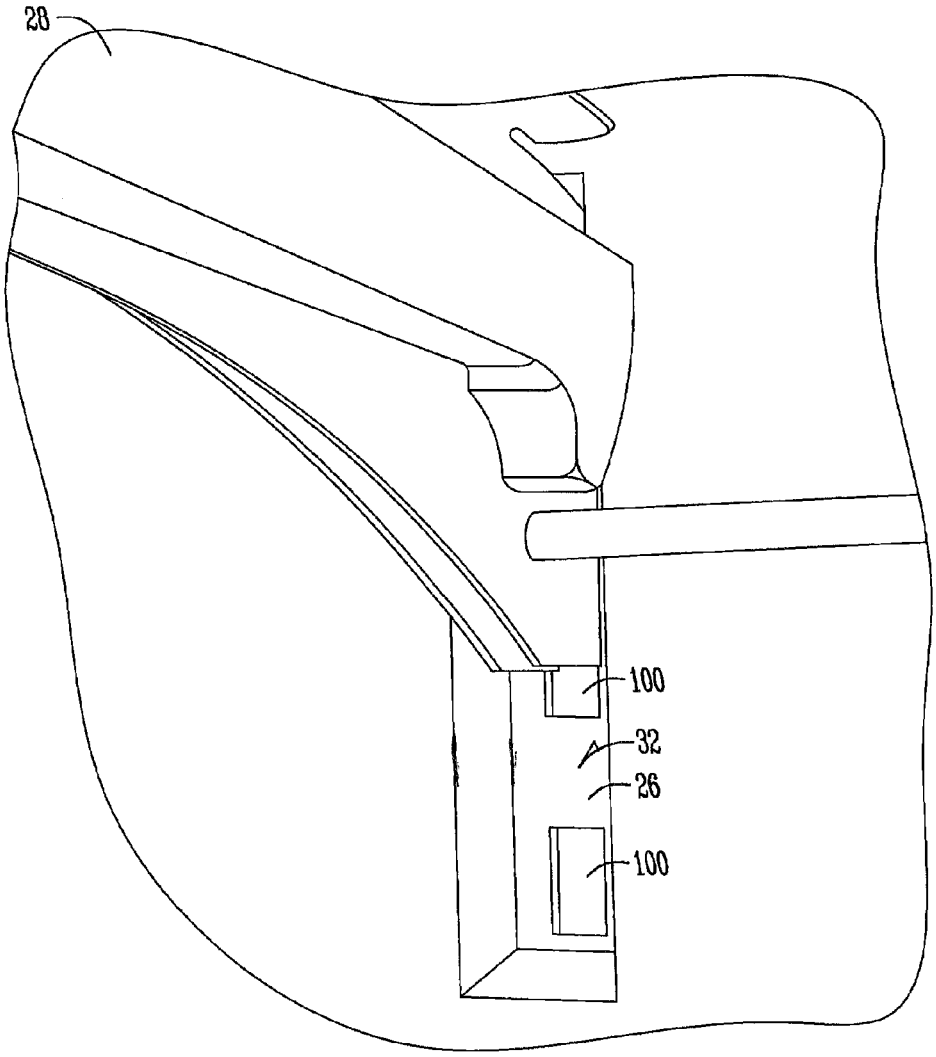
FIG. 8 illustrates a shelf connected at a rail.

FIG. 8 illustrates a shelf 28 connected at a rail 32 within a recess 26. The rail 32 may include a plurality of openings 100 which serve as shelf supports. One or more shelf supports 100 may be used for supporting the shelf 28.

Figure 9:
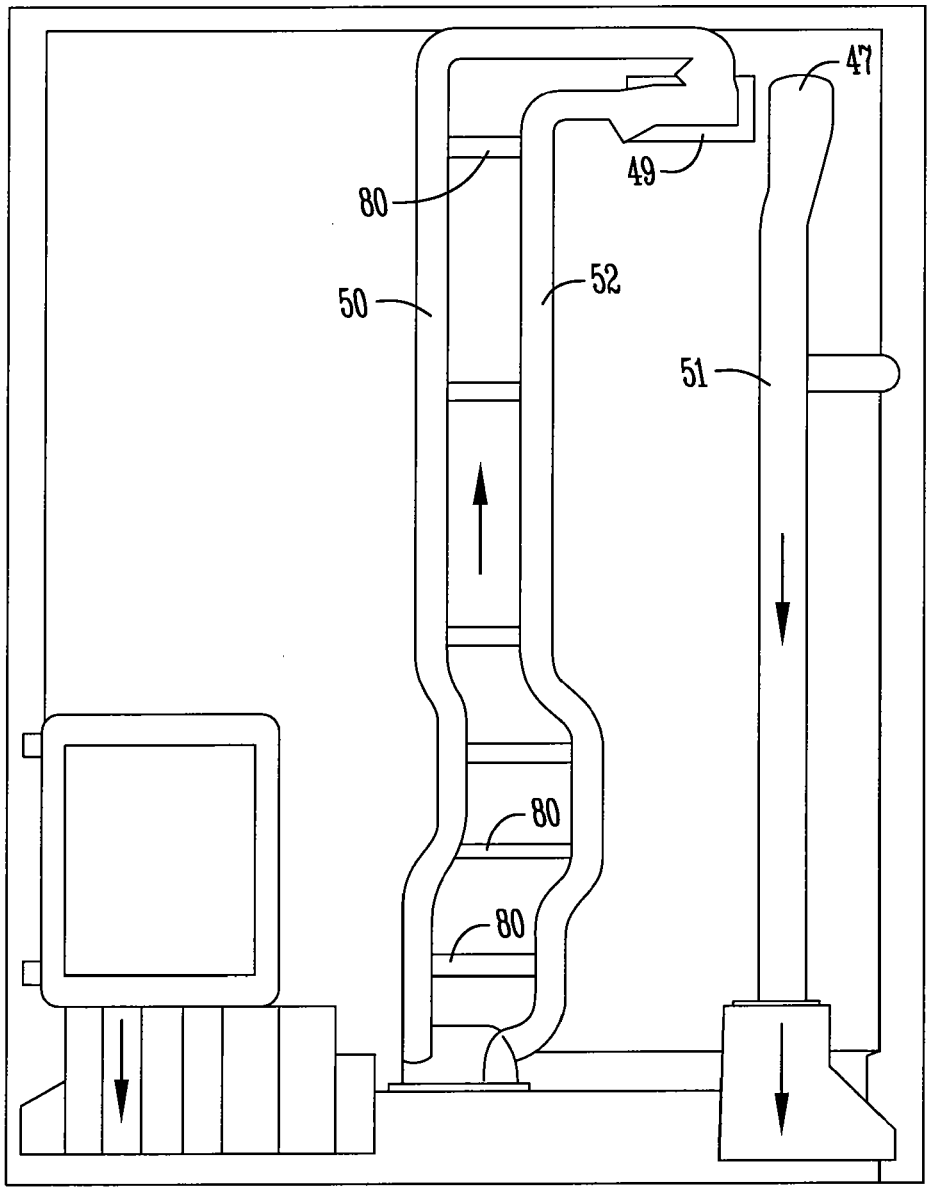
FIG. 9 illustrates a view showing air flow in the refrigerator from a rear position.

FIG. 9 illustrates a view showing air flow in the refrigerator from a rear position with the ice making compartment supply ducts 50, 52 shown for bringing cold air to the outlet 49 and the inlet 47 for providing return air.

Figure 10:
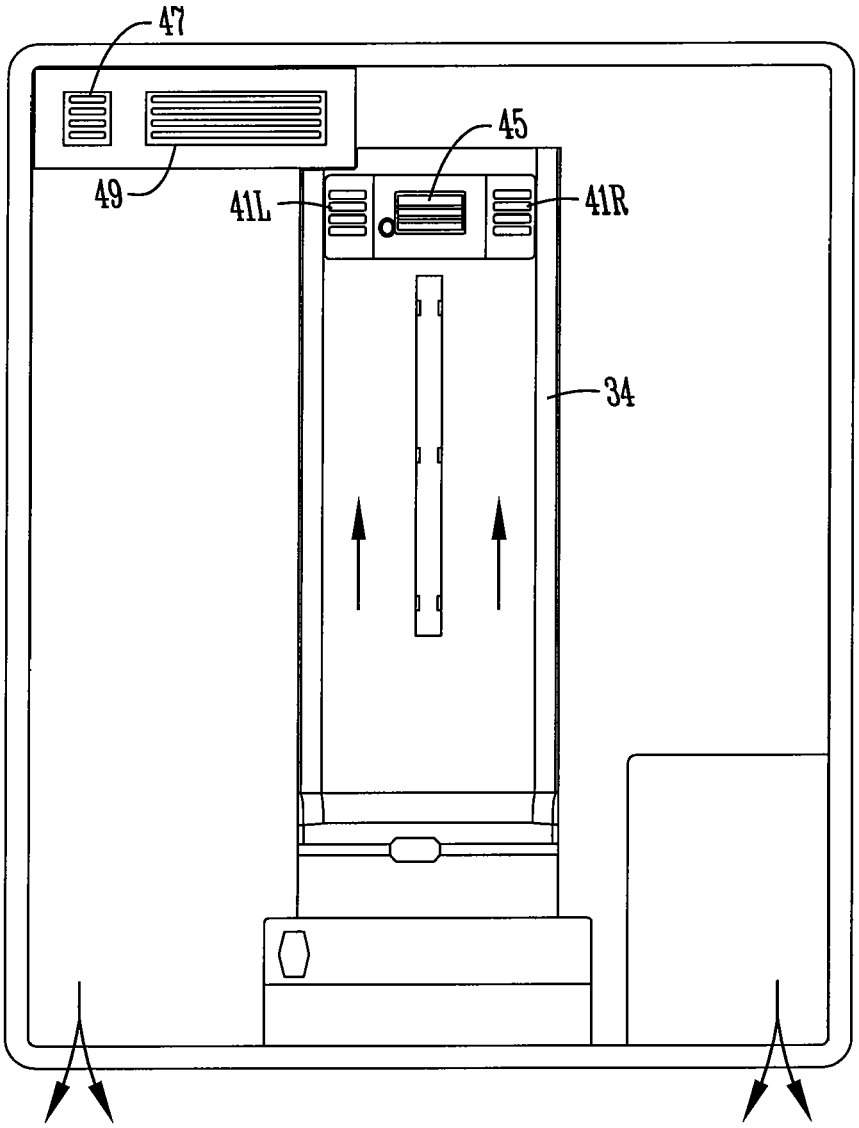
FIG. 10 is another view showing air flow in the refrigerator.

FIG. 10 is another view showing air flow in the refrigerator. The fresh food compartment duct riser 34 is shown with a filter door 45 shown near the top along with louvers 41L, 41R on opposite sides of the filter door 45. In addition, the outlet 49 for supply air to the ice making compartment and the inlet 47 for return air from the ice making compartment are also shown.

Figure 11:
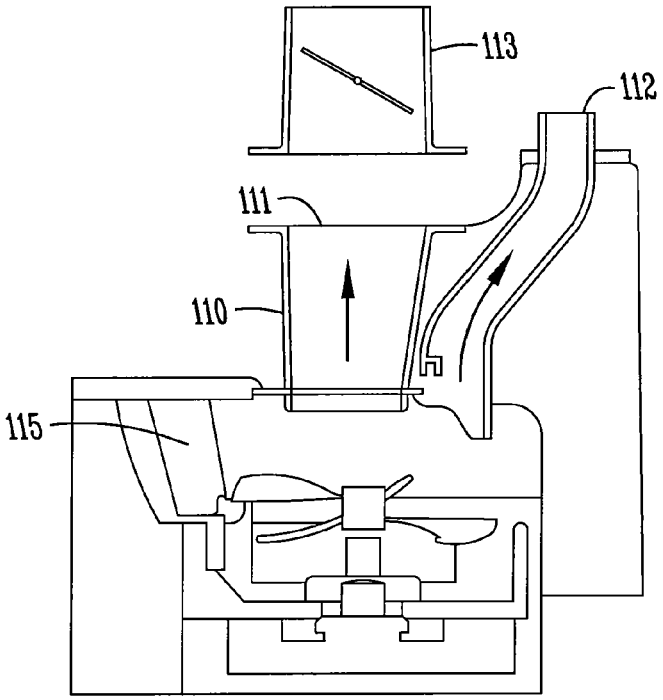
FIG. 11 illustrates ice making compartment supply and refrigeration compartment supply.

FIG. 11 illustrates ice making compartment supply and refrigeration compartment supply. An air separator 110 is shown. Air supply to the refrigeration compartment or fresh food compartment is provided at outlet 111 while air supply to the ice making compartment is provided at air outlet 112. Thus, supply air may be separated with a portion of the air conveyed to the ice making compartment and a portion of the air conveyed to the fresh food compartment. A damper 113 is also shown to control air flow from the outlet 111 of the air separator 110. In normal operation most of the cold air is directed towards the freezer compartment through outlet 115.

Figure 12:
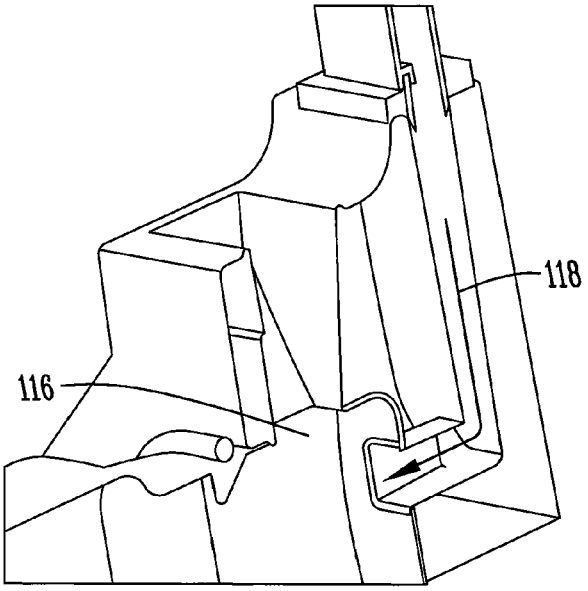
FIG. 12 returning of air to an evaporator.

FIG. 12 illustrates returning of air to an evaporator. A refrigeration compartment return inlet 116 is shown and an ice making compartment air return inlet 118 is also shown. Thus, return air from both the fresh food compartment and the ice making compartment may be merged at the evaporator.

Figure 13:
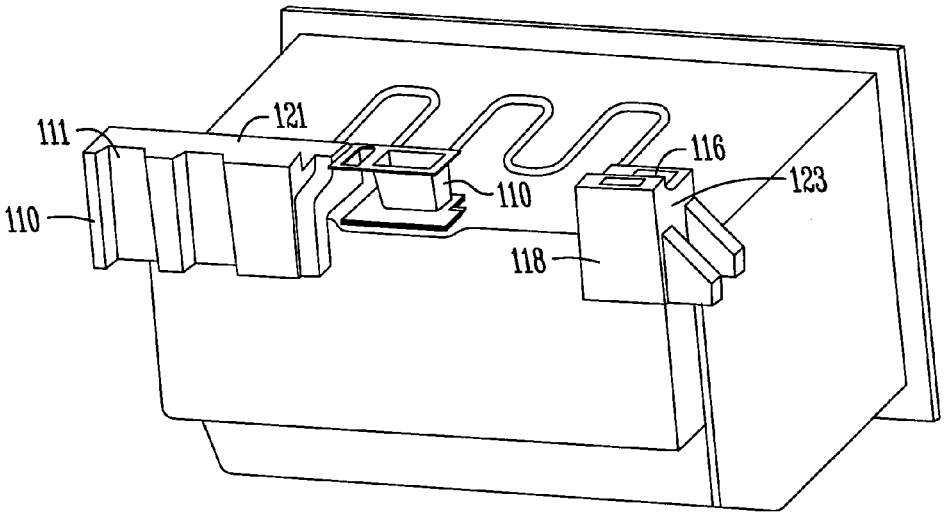
FIG. 13 provides another view for supply and return air.
Figure 14:
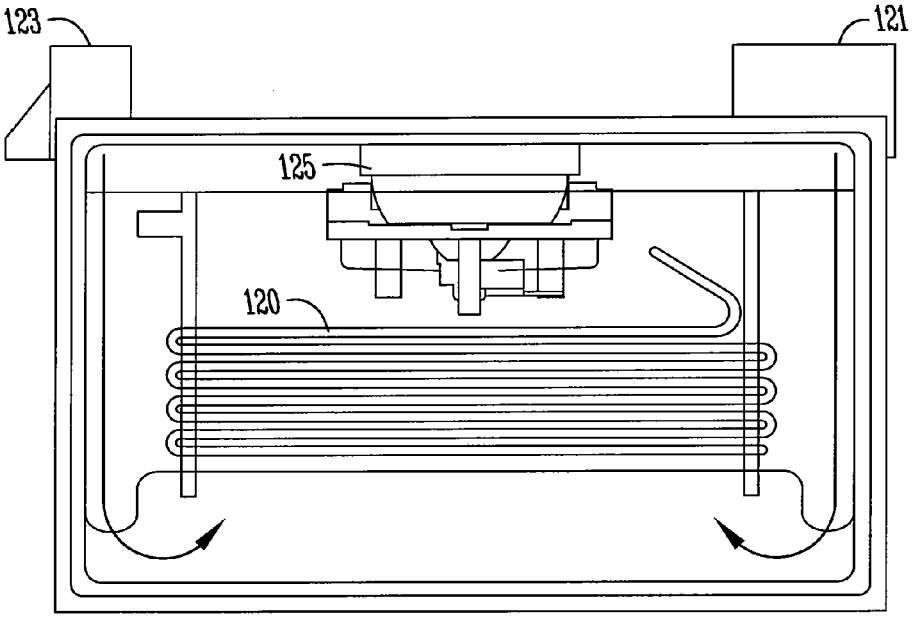
FIG. 14 illustrates return air being directed to evaporator
Figure 15:
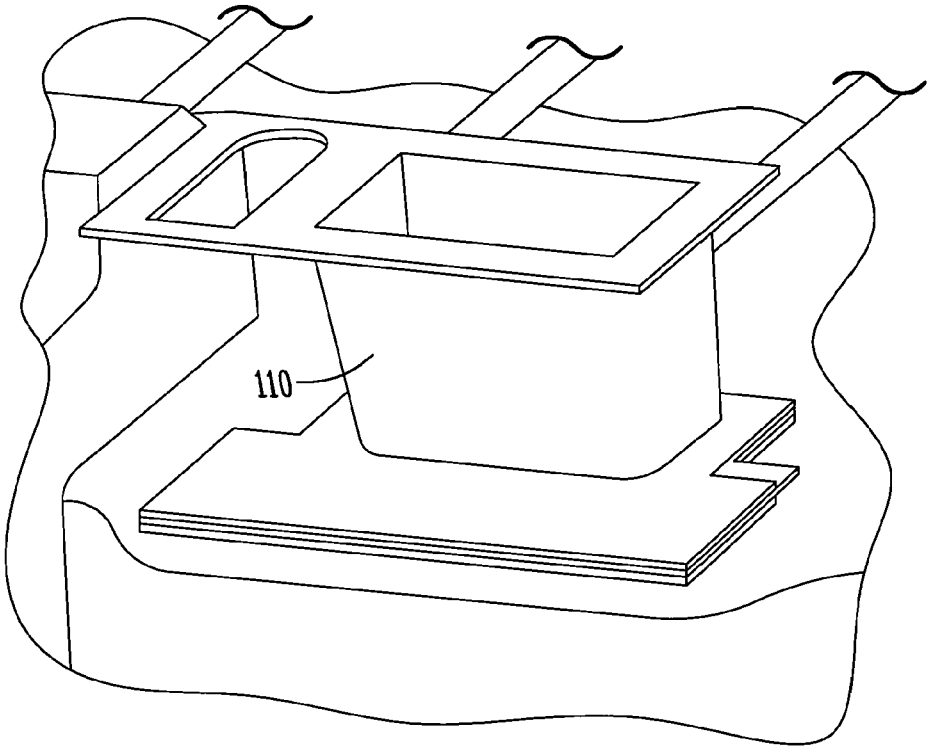
FIG. 15 illustrates an air separator.

FIG. 13 provides another view for supply and return air. The air separator 110 is shown as well as the refrigeration compartment return inlet 116 and the ice making air return inlet 118. Blocks 121, 123 are shown on opposite sides. The blocks 121, 123 may be formed from expanded polystyrene (EPS) or other type of foam. As shown in FIG. 14, return air may be directed to evaporator 120. FIG. 14 also illustrates a shroud 125 and the blocks 121, 123 on opposite sides, the blocks 121, 123 associated with air return. FIG. 15 provides another view of the air separator 110.

The invention has been shown and described above, and it is understood that many alternatives modifications, substitutions, and additions may be made which are within the intended spirit and scope of the invention. For example, the present invention may be used in various different types of refrigerator configurations, duct work may be of various types and configuration, various sources of cold air may be used, and the ice compartment duct riser may or may not be used. These and other variations, options, and alternatives may be used with the present invention.

What is claimed is:

1. A refrigerator comprising:

a refrigerator cabinet;

a freezer compartment disposed within the refrigerator cabinet;

a fresh food compartment disposed within the refrigerator cabinet;

an ice making compartment remote from the freezer compartment;

a fresh food compartment duct riser extending upwardly along a back of the fresh food compartment, the fresh food compartment duct riser having a split pathway and an opening in communication with the fresh food compartment, the fresh food compartment duct riser not being in fluid communication with the ice making compartment;

a shroud associated with a freezer compartment evaporator;

an ice compartment supply duct leading from the shroud to the ice making compartment and having an opening in communication with the ice making compartment, the ice compartment supply duct not being in fluid communication with the fresh food compartment;

an ice compartment return duct leading from the ice making compartment towards the freezer compartment evaporator;

wherein the ice compartment supply duct has a split pathway and is positioned behind the fresh food compartment duct riser.

2. The refrigerator of claim 1 further comprising a recess in the fresh food compartment duct riser between portions of the split pathway of the fresh food compartment duct riser.

3. The refrigerator of claim 2 further comprising a shelf support positioned within the recess.

4. The refrigerator of claim 3 further comprising at least one shelf supported by the shelf support.

5. The refrigerator of claim 1 wherein the ice making compartment supply duct comprises an opening at an upper portion of the fresh food compartment.

6. The refrigerator of claim 5 wherein the ice making compartment supply duct comprises pathways joined at their upper portions, separated at their intermediate portions and joined at their lower portions.

7. The refrigerator of claim 1 wherein the ice compartment supply duct has a first portion and a second portion, and wherein a plurality of ribs are positioned between the ice compartment supply duct first portion and the ice compartment supply duct second portion.

8. The refrigerator of claim 1 wherein the freezer compartment is disposed below the fresh food compartment.

9. The refrigerator of claim 1 further comprising an ice maker disposed within the ice making compartment.

10. The refrigerator of claim 1 further comprising a fresh food compartment door for providing access to the fresh food compartment and a water and ice dispenser on the fresh food compartment door.

11. The refrigerator of claim ,1 wherein the shroud is a freezer compartment fan shroud.

12. A refrigerator comprising:

a refrigerator cabinet;

a fresh food compartment disposed within the refrigerator cabinet;

a freezer compartment disposed within the refrigerator cabinet and below the fresh food compartment;

an ice making compartment remote from the freezer compartment, the ice making compartment containing an ice maker;

a fresh food compartment duct riser extending upwardly along a back of the fresh food compartment and having an opening in communication with the fresh food compartment, the fresh food compartment duct riser not being in fluid communication with the ice making compartment;

an ice compartment supply duct leading upwardly through the fresh food compartment duct riser and having an opening in communication with the ice making compartment, the ice compartment supply duct not being in fluid communication with the fresh food compartment; and an ice compartment return duct leading downwardly from the ice making compartment.

13. The refrigerator of claim 12 wherein the fresh food compartment duct riser has a first portion and a second portion and recess between the first portion and the second portion.

14. The refrigerator of claim 13 wherein the ice compartment supply duct comprises a first ice making compartment supply duct and a second ice making compartment supply duct; and the first and second ice making compartment supply ducts share an opening, at an upper portion of the fresh food compartment.

15. The refrigerator of claim 14 wherein the first ice making compartment supply duct and the second ice making compartment supply duct are joined at their upper portions, separated at their intermediate portions, and joined at their lower portions.

16. The refrigerator of claim 12 wherein the fresh food compartment duct riser has a split air pathway and further comprising a recess in the fresh food compartment duct riser between portions of the split pathway.

17. The refrigerator of claim 16 further comprising a shelf support positioned within the recess.

18. The refrigerator of claim 17 further comprising at least one shelf supported by the shelf support.

19. A refrigerator comprising:

a refrigerator cabinet;

a fresh food compartment disposed within the refrigerator cabinet;

a freezer compartment disposed within the refrigerator cabinet and below the fresh food compartment;

an ice making compartment remote from the freezer compartment, the ice making compartment containing an ice maker;

an ice compartment supply duct leading upwardly to the ice making compartment for supplying air to the ice making compartment, the ice compartment supply duct having a first portion and a second portion, the first portion and the second portion joined at a top of the ice compartment supply duct, separated at intermediate portions, and joined at a lower portion of the ice compartment supply duct;

an ice compartment return duct leading downwardly from the ice making compartment for returning air from the ice making compartment;

a fresh food compartment duct riser extending upwardly along the back of the fresh food compartment and having an opening in communication with the fresh food compartment, the fresh food compartment duct riser covering the ice compartment supply duct and having a split air pathway with a recess;

a shelf support positioned within the recess; and at least one shelf supported by the shelf support.

* * * * *